US006713728B1

(12) United States Patent
Justice et al.

(10) Patent No.: US 6,713,728 B1
(45) Date of Patent: Mar. 30, 2004

(54) DRUM HEATER

(75) Inventors: Patrick B. Justice, Portland, OR (US); Larry E. Hindman, Woodburn, OR (US); Trevor J. Snyder, Newberg, OR (US); Michael P. O'Dierno, Beaverton, OR (US); Jeffrey R. Kohne, Tualatin, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/378,136

(22) Filed: Feb. 27, 2003

Related U.S. Application Data

(60) Provisional application No. 60/413,701, filed on Sep. 26, 2002.

(51) Int. Cl.[7] ..... G03G 15/20; H05B 3/16

(52) U.S. Cl. ..... 219/469; 219/216; 219/470; 219/534; 219/542; 219/548; 399/331; 399/333

(58) Field of Search ..... 219/216, 469, 219/470, 521, 534, 538, 539, 542, 548, 550; 399/330, 331, 333, 334

(56) References Cited

U.S. PATENT DOCUMENTS

| | | | | |
|---|---|---|---|---|
| 3,209,988 A | | 10/1965 | Fox | |
| 3,322,931 A | | 5/1967 | Laing | |
| 3,612,824 A | | 10/1971 | Berryman | 219/370 |
| 3,805,020 A | * | 4/1974 | Bates | 219/469 |
| 3,943,329 A | | 3/1976 | Hlavac | 219/367 |
| 3,981,314 A | | 9/1976 | Barradas | 132/9 |
| 4,198,557 A | | 4/1980 | Crowley | 219/370 |
| 4,198,558 A | | 4/1980 | Benty | 219/370 |
| 4,659,206 A | | 4/1987 | Kai | 355/3 DR |
| 5,445,700 A | * | 8/1995 | Uang | 219/469 |
| 5,614,933 A | | 3/1997 | Hindman | 347/103 |

FOREIGN PATENT DOCUMENTS

| | | |
|---|---|---|
| JP | 05-282747 | * 10/1993 |

* cited by examiner

*Primary Examiner*—Joseph Pelham
(74) *Attorney, Agent, or Firm*—Phil Virga; E. O. Palazzo

(57) ABSTRACT

A drum heater consisting of a plurality of vanes made preferably from mica material and having multiple separate heater wire channels controlled from an electrical cable is provided for heating the interior of a printer drum or fuser. The drum heater has element wires, which can be operated in two different modes, and which are wound around eight mica vanes. The mica vanes are held together on both ends with mica end caps for assembly, electrical isolation and thermal isolation. The mica vanes additionally define protruding tabs for attachment of wire restraining and protecting mica panels.

20 Claims, 5 Drawing Sheets

DRUM HEATER

This application is based on a Provisional Patent Application No. 60/413,701, filed Sep. 26, 2002.

BACKGROUND

Many printing technologies require some sort of heated drum or roller. The most common example is the heated rollers used to create a hot nip in a laser printer fuser. A heated roller can also be used in an aqueous ink-jet printing system to decrease the drying time and thus increase printing speed. In the Xerox offset solid ink printing process, a heated drum is used to support the entire image prior to its transfer to the media. This elevated temperature maintains the ink in a viscoelastic state, which allows it to spread and penetrate into the media during transfer. This increases solid fill density, decreases pile height, and increases the durability of the prints.

These systems are unable to print until they have reached their respective operating temperatures. The time it takes to achieve the operating temperature is proportional to the temperature and the mass of the system—both of which can be very high. By way of example, the temperature required in a solid-ink printing system is around 65–70 degrees centigrade, while that in a laser fusing system is in the range of 150–300 degrees centigrade. Because of these high temperatures and masses, a rather large power is typically required in order to keep warm-up time to an acceptable minimum. It is not uncommon to see heating systems with power requirements in the range of 300–800 watts and even much more. However, this high power does come at a cost. Higher wattage heaters result in larger and larger current draws on the AC line. AC lines all have a certain amount of impedance (or resistance to the current flow). This line impedance can cause the power to flicker when the heater turns on and if the heater is too large (for example, incandescent lights near the printer may flicker which is unacceptable to our customer). Therefore, the upper and lower power level is determined by the need for faster warm-up time without excessive flicker.

In order to meet the requirements of worldwide customers, the entire printer must be designed to operate at any line voltage that might be encountered. This can be done by designing multiple heaters with multiple power supplies. For instance, one heater/supply combination for US, one for Japan, and one for Europe. However, this reduces volume, increases cost, and introduces more complexity into the logistics of both manufacturing and service. Another method that is used is to design the printer with an auto-switching power supply that works between 87V (low line in Japan) and 265V (high line in Europe and Australia) and automatically detects what line voltage is being applied. This is advantageous because a single printer can be manufactured and distributed throughout the world. AC cycle-dropping is used to control the average power to the heaters. The design challenge in this case is to develop a heating system that can operate at 87–265VAC and meet the combined requirements of cost, warm-up time, and low flicker. Therefore a need exists for a drum heater able to achieve all of these design requirements.

SUMMARY

A drum heater consisting of a plurality of vanes made preferably from mica material and having one or more separate heater wire channels controlled from an electrical cable is provided for heating the interior of a printer drum or fuser. The drum heater has one or more heater channels defined by separate heating element wires thereby creating different resistances. These are wound around the mica vanes. The various channels can be operated alone, in serial, in parallel, or in some combination thereof, which creates more possible heater fluxes than actual heater channels. In conjunction with AC cycle-dropping, these various heater fluxes can be used to optimize warm-up time while reducing flicker during both warm-up and steady-state operation as well as provide redundant heating for increased reliability and/or limp-mode operation until a service technician can fix a broken heater. The mica vanes are held together on both ends with mica end caps for assembly, electrical isolation and thermal isolation. The mica vanes additionally define protruding tabs for attachment of narrow mica panels which protect the element wire from handling damage and prevent a broken element wire from contacting the interior of the drum or fuser. Internal mica "baffles" are further used to increase efficiency and/or vary the flux from center to ends of the drum or fuser.

Additional objects and advantages of this invention will be apparent from the following detailed description that proceeds with reference to the accompanying drawings.

DETAILED DESCRIPTION

Figure 1:
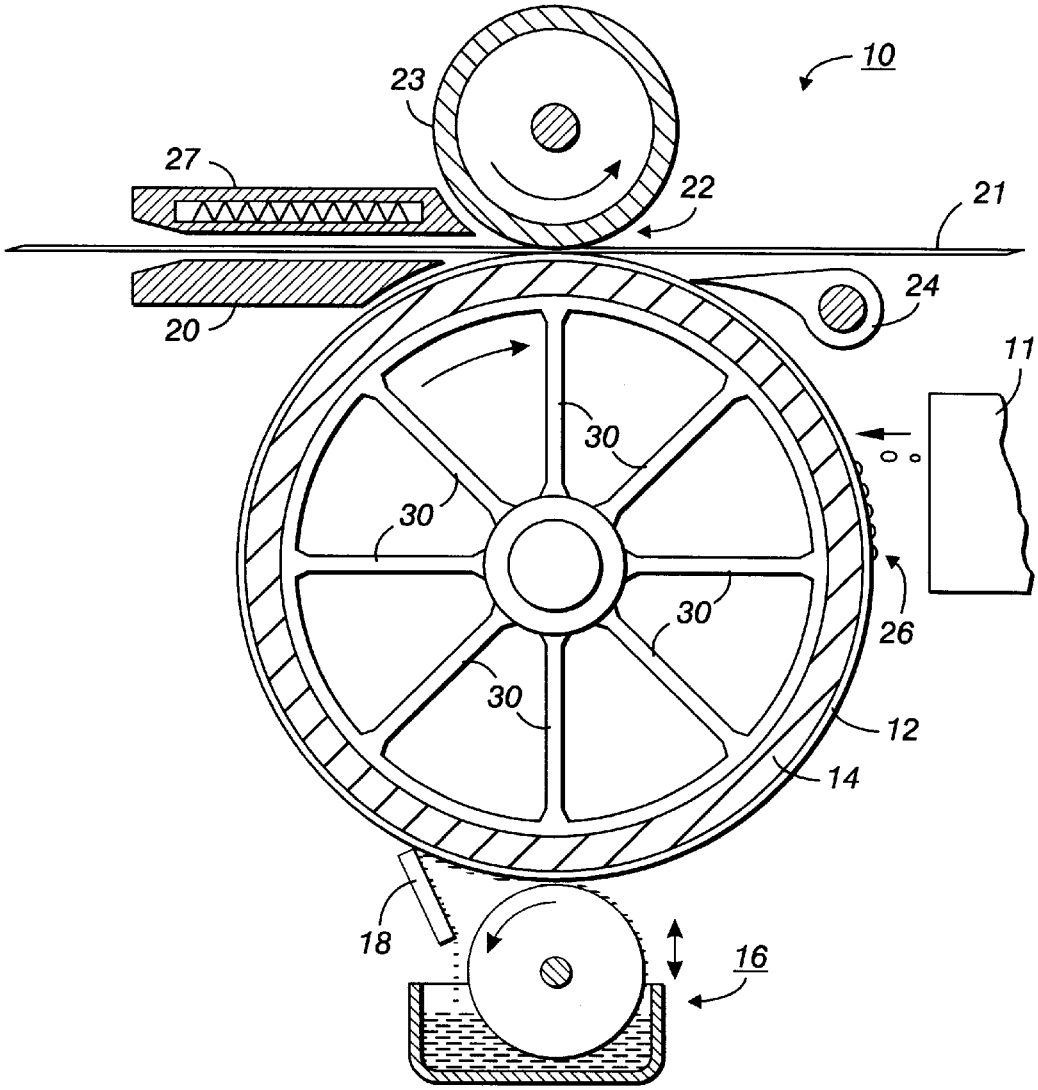
FIG. 1 illustrates a solid-ink offset printing process.

The drum heater of the present invention is designed for use in a network office color printer but may also be used in a laser printer using laser-imaging technology. The printer uses an offset printing process and piezoelectric print head technology that jets solid ink. FIG. 1 shows an imaging apparatus 10 utilized in this process to transfer an inked image from an intermediate transfer surface to a final receiving substrate. A print head 11 is supported by an appropriate housing and support elements (not shown) for either stationary or moving utilization to place an ink in the liquid or molten state on a supporting intermediate transfer surface 12 that is applied to a supporting surface 14. Intermediate transfer surface 12 is a liquid layer that is applied to supporting surface 14, such as a drum, band, platen, or other suitable design, by contact with an applicator, such as a metering blade, roller, web, or wicking pad contained within an applicator or blade metering assembly 16.

Applicator assembly 16 optionally contains a reservoir 18 for liquid application and most preferably contains a roller to periodically present oil to the drum 14. Applicator apparatus 16 is mounted for retractable movement upward into contact with the surface of drum 14 and downwardly out of contact with the surface of the drum 14 and its intermediate transfer surface 12 by means of an appropriate mechanism, such as a cam, an air cylinder, or an electrically actuated solenoid.

In this process, a proprietary solid, or hot melt, ink is placed into a heated reservoir where it is maintained in a liquid state. This highly engineered ink is formulated to meet a number of constraints, including low viscosity at jetting temperatures, specific viscoelastic properties at drum-to-media transfer temperatures, and high durability at room temperatures. Once within the printhead, the liquid ink flows through manifolds to be ejected from microscopic orifices through use of proprietary piezoelectric transducer (PZT) printhead technology. The duration and amplitude of the electrical pulse applied to the PZT is very accurately controlled so that a repeatable and precise pressure pulse can be applied to the ink, resulting in the proper volume, velocity, and trajectory of the droplet. The individual droplets of ink are jetted onto a liquid layer of silicone oil, which is supported by a rotating aluminum drum 14. The drum 14 and liquid layer are held at a specified temperature with the use of a drum heater such that the ink hardens to a ductile viscoelastic state. After the entire image has been jetted onto the liquid layer on the drum 14, it is transferred and fixed, or transfixed, onto pre-heated receiver media 21 (paper, transparency, etc). A high durometer synthetic pressure roller 23, when placed against the drum 14, develops a high-pressure nip that compresses the paper and ink together, spreads the ink droplets, and fuses the ink droplets into the media 21.

Referring once again to FIG. 1, a final substrate guide 20 and media preheater 27 passes a final receiving substrate 21, such as paper, from a positive feed device (not shown) and guides it through a nip 22 formed between the opposing actuated surfaces of a roller 23 and intermediate transfer surface 12 supported by drum 14. Stripper fingers 24 (only one of which is shown) may be pivotally mounted to imaging apparatus 10 to assist in removing final receiving substrate 21 from intermediate transfer surface 12. Roller 23 has a metallic core, preferably steel, with an elastomeric covering and engages final receiving substrate 21 on a reverse side to which an ink image 26 is transferred from intermediate transfer surface 12.

Figure 2:
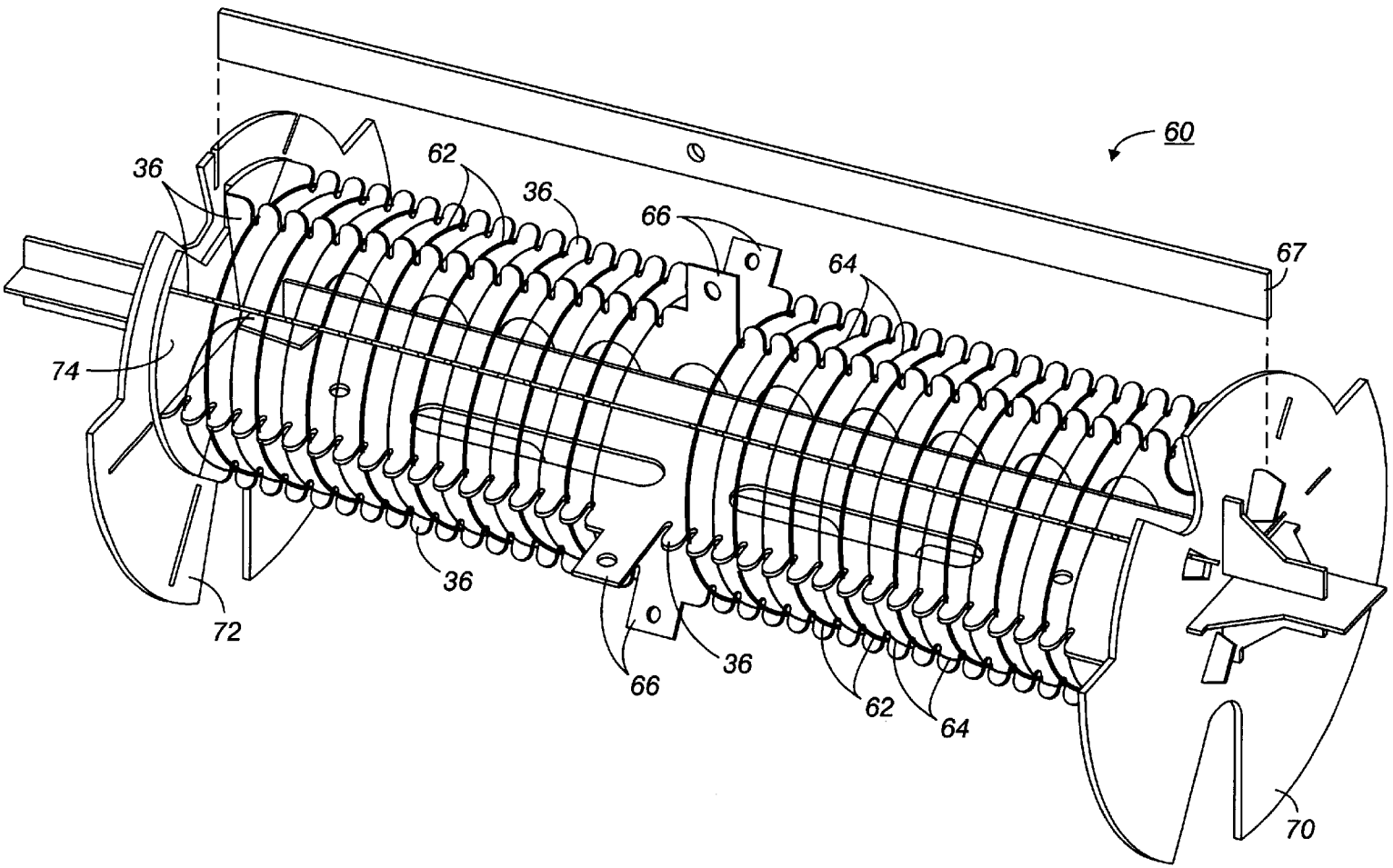
FIG. 2 is an isometric view of the drum heater in accordance with the present invention.

Referring to FIG. 2, heat is added to drum 14 by drum heater 60 that preferably consists of a plurality of vanes 36 made preferably from mica material and has two separate heater wire channels. In this embodiment two heater channels are shown. These wires can be of similar or different diameter, 62 and 64 respectively, and are wound around the mica vanes 36. These mica vanes 36 are held together on both ends with mica end caps 70, 72 and 74 for assembly, electrical isolation and thermal isolation. The mica vanes 36 additionally define protruding tabs 66 for attachment of mica restraining panels 67 (one of which is shown) which protect and restrain the element wire. As shown in FIG. 2, eight mica vanes 36 form the assembly.

Figure 3:
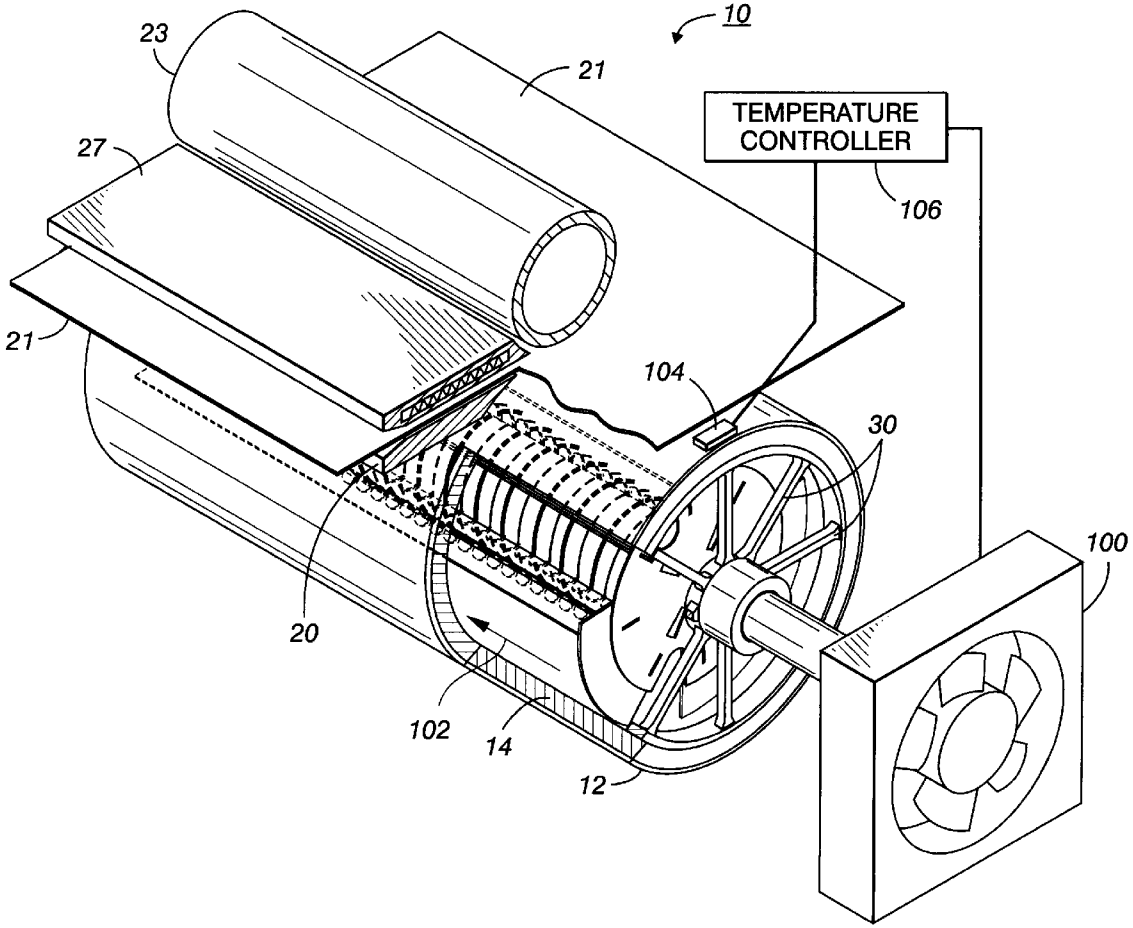
FIG. 3 illustrates thermal control utilizing the heater drum of FIG. 2 in a solid-ink offset process.

Referring now to FIG. 3, the drum 14 of imaging apparatus 10 is cooled by moving air through the tube 30 with a fan 100. Of course, fan 100 may push or pull air in either direction through drum 14 to accomplish cooling. Preferably, fan 100 blows air through drum 14 in a direction indicated by an arrow 102. Media preheater 27 is set to a predetermined operating temperature by conventional thermostatic means. Drum temperature is sensed by a thermistor 104 that contacts drum 14 and is electrically connected to a conventional proportional temperature controller 106. Depending on the rate of cooling or heating required, temperature controller 106 may proportionally control one or both of drum heater 60 and fan 100. Small temperature changes primarily entail temperature controller 106 altering the amount of electrical power supplied to drum heater 60.

During power-on from a cold start and warm-up out of Energy Star mode, the printer is unable to print until the drum reaches its set point of approximately 50–70 degrees centigrade. Therefore, it is desirable to have a high power drum heater reduce warm-up time, which is important to customers. However, higher wattage heaters result in larger current draws on the AC line. This is not generally a problem during warm-up as the current draw is consistent, however, reduced power requirements during printing and/or standby result in flicker. This is due to the fact that AC lines all have a certain amount of impedance (or resistance to the current flow). This line impedance can cause the power to flicker if large current draws are turned on and off a low frequency, i.e., anytime the printer is in a lower power mode (standby, ready, or actively printing). For example, this flicker will cause incandescent lights near the printer to flicker, which is unacceptable. Therefore, fast warm-up time and flicker constrain the upper and lower power level of drum heater designs. In an attempt to balance these requirements in the preferred embodiment, the maximum power of the heater is designed to be 600 watts. Therefore, every time the printer is turned on or comes out of Energy Star mode, the heater will typically be given the full 600 W of power until the drum is heated to its set point. After this initial warm-up, the drum heater is used at a much lower duty-cycle to keep the drum at its set point. This is accomplished by measuring the temperature with a thermistor and controlling the power to the heater with a PID controller As described above, the preferred embodiment of the drum heater has two separate heater channels, allowing for two operating modes. The two element wires are operated in parallel at 100 V (referred to here as Mode 1) and in series at 200 V (referred to here as Mode 2). The switching mechanism used is a double pole double throw relay, which receives a switching signal from the printer electronics. Mode 1 provides 600 watts at 100 V and is designed to operate in lower line voltage countries like the USA and Japan. Mode 2 provides 600 watts at 200 V and is designed to operate in higher line voltage counties like Europe and Australia.

Figure 5:
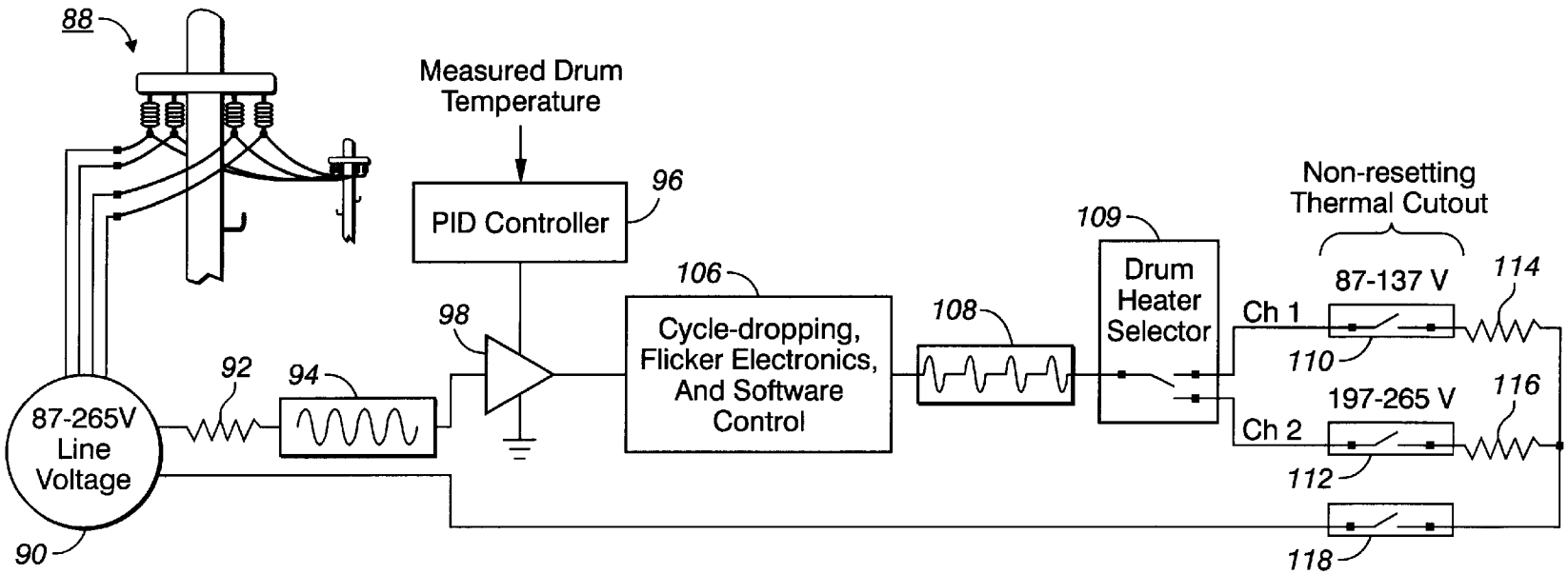
FIG. 5 illustrates the circuit diagram for two methods of using two elements to achieve the same power setting at two different line voltages.

In a different embodiment (as shown in FIG. 5), the design can more simply consist of 2 independent element wires—one used solely for 100V operation and one used solely for 200V operation. With this design the 200V heater can actually be used in the 100V environment as a sustaining heater that is more suited for lower power levels and will greatly reduce flicker. This allows 3 useable heat fluxes from only two physical heaters. The preferred embodiment was chosen over the different embodiment because in the series/parallel design, the element wires themselves are the same diameter and same length. This adds to the simplicity of the design, particularly regarding the coiling features on the 8 mica vanes. In addition, the series/parallel design results in two equal sized wires of an intermediate diameter whereas the different embodiment consists of one wire which is larger in diameter (and stronger) and one wire which is small in diameter (and much weaker). The equal sized wires provide higher overall reliability.

Mode 1 is designed for a nominal 100V line that will be used for all low voltage operation between 87V to 132V. Mode 2 is designed for a nominal 200V line that will be used for all high voltage operation (198V to 265V). Since 600 watts of power is needed to heat the drum during warm-up from cold start, both Mode 1 and Mode 2 are designed to provide 600 watts. The following shows an example of the current, voltage, and resistance for Mode 1 and 2

| | Mode 1 Low Voltage Heater | Mode 2 High Voltage Heater |
|---|---|---|
| Design Voltage | 100 V | 200 V |
| Current | 6 Amps | 3 Amps |
| Equivalent Resistance | 16.67 Ohms | 66.67 Ohms |

In general, the heater dimensions are controlled by the size of the imaging drum, which is driven by the size of the imaging media and the necessary applied mechanical loads. One end of the heater protrudes out of the drum and is attached to the chassis of the printer. The other end of the heater is attached to a bearing pin, which runs on a rotating bushing interior to the same end on the drum. Therefore, the heater does not rotate, but rather the drum rotates around the heater. The overall length of the heater from end-to-end is controlled by the mounting bracket location (not shown) on the chassis.

Figure 4:
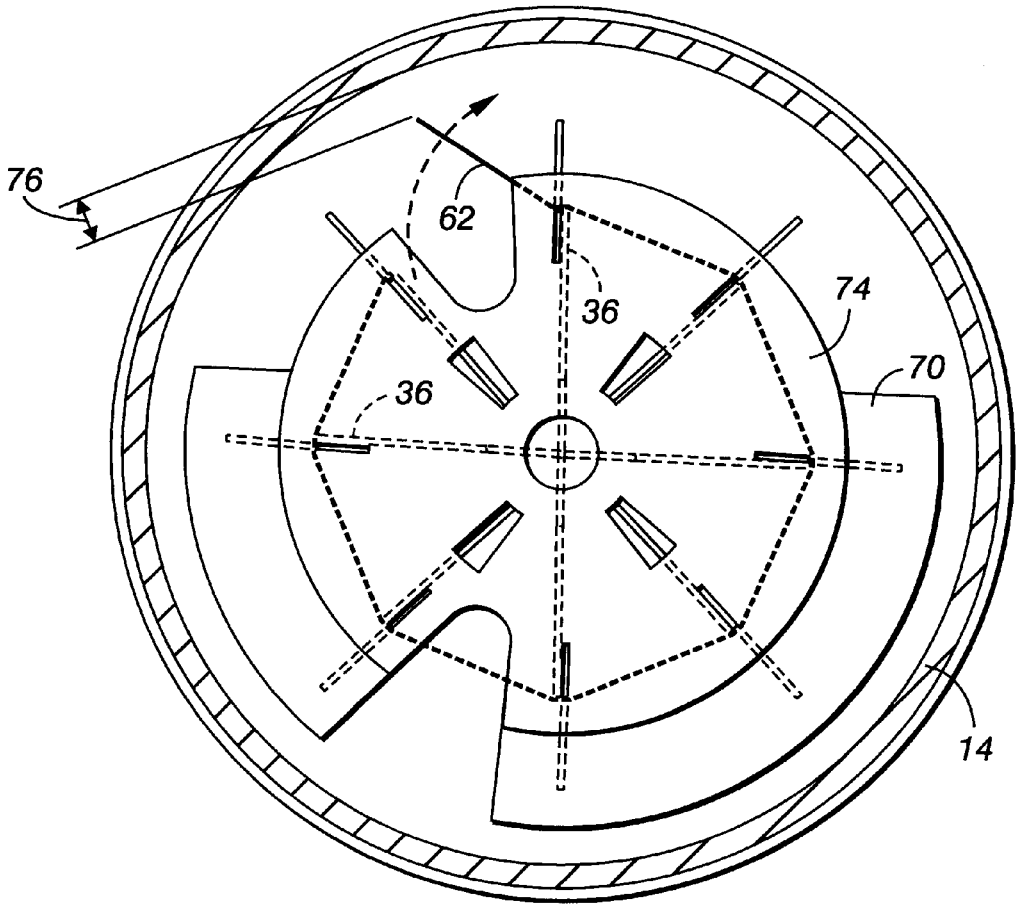
FIG. 4 illustrates a UL protection mechanism in accordance with one embodiment of the invention.

Referring to FIG. 4, the drum 14 in the printer rotates on bearings and is not "safety" grounded per UL requirements. In order to meet UL requirements with a non-grounded drum, it must be insured that under no circumstances will a drum heater wire 62 ever touch the drum or endbells 30. This requirement is what limits the overall outside diameter of the drum heater. This insures that if a heater wire 62 breaks at any point, it will be impossible for the wire to bend out and touch the drum 14. In fact, there needs to be a 5 mm air gap 76 between the wire and any feature on either the drum 14 tube or the endbell that supports the drum tube for the worst case wire break locations. This requirement sets the dimensions for using 8 mica vanes 36 as opposed to say 4 to minimize the length of the freely hanging wire sections such that a freely hanging broken wire could not touch the drum surface.

In another embodiment, the heater wire may not be wrapped uniformly down the mica vanes in this design. It may be desired in some cases to increase the power density towards the outside of the heater for both heater channels. Testing and experience has demonstrated that the drum looses more heat at the ends then in the center. This power distribution is intended to achieve a more uniform temperature across the entire axial length of the drum. In the current design, the element wires are uniformly coiled down the mica vanes but end losses are reduced by the use of heat-trapping baffles, which are integrated as part of the mica end caps (shown in FIG. 2 72 and 70). As design and testing advances, the exact power distribution may be adjusted slightly in order to further reduce any measured temperature gradient.

Referring now to FIG. 5, In order to meet the requirements for worldwide customer usage, the entire printer must be designed to operate at any line voltage 88 that might be encountered. To achieve this, the printer is designed with an auto-switching power supply 90 that works between 87V (low line in Japan) and 265V (high line in Europe and Australia) and automatically detects what line voltage 92 is being applied. While the printer must be designed to operate at this very extreme voltage range for extended periods of time (up to the entire life of the printer), the heaters in the printer do not. While the drum heater 96 is connected 98 to the line voltage, the RMS voltage 94 at the heaters is reduced through "AC Cycle Dropping" 106. This keeps the heaters at or below their rated power (on average) regardless of the line voltage. Therefore, each of the 600-watt heaters will only see a maximum of 600 W regardless of the line voltage the printer is operating on.

The use of AC line voltage 108 to provide controlled power in a printer is very cost effective as it can be applied directly to the loads without any conversion and has a large power capacity. In color printers, large power demands would add product cost if DC were to be used, and controlled AC offers an attractive alternative. By using a "zero crossing detector," a Triac can be used to control how many line cycles are passed to the load (heater). For example, in Mode 1 (the 100V channel), if the line voltage is 100VAC, then all cycles are allowed to pass. If the line voltage is 140VAC, then only a portion of the cycles are allowed to pass to the load. For example, a 100 ohm heater at 100 volts would draw 1 amp and produce 100 watts with all the cycles on. At 140 volts the same heater will draw 1.4 amps and provide 196 watts instantaneously, but would be turned on only about 1 out of 2 cycles making the average power to the heater only 100 watts. By controlling the portion of cycles to the heater, it will see the same effective power under any line voltage. Therefore, heaters and triacs must be designed to take the peak transient currents and watts up to high line voltage, but not peak steady-state currents and wattages. Many of the heaters in current printers fail quickly when subject to high line voltage for continuous AC cycles, however, work for the life of the printer with cycle-dropping.

In accordance with the invention, the resistance and power of the heaters in the printer are specified at some nominal voltage depending on the requirements of the heater. This is typically either 100V or 200V. High line voltage is approximately defined at 10% higher than the standard line voltage. For example, the USA operates at 120V and high line voltage would be about 132V. This drum heater design operates in both a 100V mode and a 200V mode, and so the maximum voltage each mode will see is the high line voltage for each of their ranges. For example, the 100V line should see no more than 132VAC peak RMS voltage while the 200V line should see not more 264 peak RMS voltage. Any voltage that is used less than 100V or less than 200V for mode 1 and mode 2 respectively will result in all cycles being sent to the heater. As the voltage is increased above 100V or 200V line voltage up to 132V or 264V, cycle dropping will reduce the number of cycles to the printer resulting in wattage equivalent to that at 100V or 200V, respectively.

Reliability is extremely important for this heater design. This printer is a high duty cycle network printer that will have a service life of between 300,000 to 500,000 prints and is expected to remain in use for up to 5 years. The use of multiple heater channels in serial and/or parallel operation not only allow for reduced flicker and increased warm-up, but also allow for increased reliability. This is true because of the increased ability to operate the heaters at their rated wattage rather than at higher wattages for short intervals. Basically this had the effect of reducing thermal/mechanical stresses caused by repeated warm-ups and cycle dropping.

Additionally, turning once again to FIG. 5, thermal cutoffs 110, 112 and 118 are provided for safety. These are needed in case a triac fails or anything results in one or both of the heaters become stuck in a powered-on condition (and not thermally controlled). Two cutouts 110 and 112 are placed in series on the common neutral line, between the double pole double throw relay 109 and the power supply. These cutoffs are located near the outside of the drum and are therefore, not part of the drum heater. Since the drum temperature set point is about 70 degrees centigrade, the cutoffs need to blow at a temperature slightly higher than 70 degrees centigrade. Using 22 series cutoffs type No. 221R or J series cutoffs type No. J086 114 and 116, respectively solve this problem. These are rated at 250V/10 amps and 125V/15 amps. As these cutoffs are mounted external to the drum heater, they should not affect the heater design It is appreciated that various other alternatives, modifications, variations, improvements, equivalents or substantial equivalents of the teachings herein that for example, are or may be presently unforeseen, unappreciated or subsequently arrived at by applicants or others are also intended to be encompassed by the claims and amendments thereto.

What is claimed is:

1. A drum heater comprising:

a plurality of vanes forming a plurality of separate heater wire channels controlled from an electrical cable wherein the vanes are held together on both ends with mica end caps for assembly, electrical isolation and thermal isolation.

2. The drum heater according to claim 1, further comprising:

Multiple element wires which can be operated separately and/or in either in series or in parallel, and which are wound around the mica vanes.

3. The drum heater according to claim 1, further comprising:

vanes made from mica.

4. The drum heater according to claim 1, further comprising:

enough vanes to achieve sufficient air gap for UL requirements.

5. The drum heater according to claim 1, further comprising:

vanes defining protruding tabs for attachment of wire restraining and protecting mica panels.

6. The drum heater according to claim 1, further comprising:

high wattage for reduced warm-up time without requiring multiple power supplies in different countries.

7. The drum heater according to claim 1, further comprising:

lower wattage for reduced flicker during standby and printing.

8. The drum heater according to claim 1, further comprising:

operation at a wide range of voltages.

9. The drum heater according to claim 1, further comprising:

controlling temperature gradients along the length of a drum or fuser either by spacing of wires or by heat trapping baffels.

10. The drum heater according to claim 1, further comprising:

reduced inrush currents.

11. The drum heater according to claim 1 further comprising the use of one or more of the various heater channels to be used out of its nominal design in order to provide a limp-mode in which the printer can be used at reduced performance until the time service can be performed on a broken heater channel.

12. A drum heater comprising:

a plurality of vanes forming a plurality of separate heater wire channels controlled from an electrical cable wherein the vanes are held together on both ends with mica end caps for assembly, electrical isolation and thermal isolation wherein multiple element wires which can be operated separately and/or in either in series or in parallel, and which are wound around the mica vanes.

13. The drum heater according to claim 12, further comprising:

enough vanes to achieve sufficient air gap for UL requirements.

14. The drum heater according to claim 12, further comprising:

vanes defining protruding tabs for attachment of wire restraining and protecting mica panels.

15. The drum heater according to claim 12, further comprising:

high wattage for reduced warm-up time without requiring multiple power supplies in different countries.

16. The drum heater according to claim 12, further comprising:

lower wattage for reduced flicker during standby and printing.

17. The drum heater according to claim 1, further comprising:

operation at a wide range of voltages.

18. The drum heater according to claim 1, further comprising:

controlling temperature gradients along the length of a drum or fuser either by spacing of wires or by heat trapping baffles.

19. The drum heater according to claim 1, further comprising:

reduced inrush currents.

20. A drum heater comprising:

a plurality of vanes forming a plurality of separate heater wire channels controlled from an electrical cable wherein the vanes are held together on both ends with mica end caps for assembly, electrical isolation and thermal isolation wherein multiple element wires which can be operated separately and/or in either in series or in parallel, and which are wound around the mica vanes further of one or more of the various heater channels to be used out of its nominal design in order to provide a limp-mode in which the printer can be used at reduced performance until a time service can be performed on a broken heater channel.

* * * * *